US009523255B2

(12) United States Patent
Andrzejak

(10) Patent No.: US 9,523,255 B2
(45) Date of Patent: Dec. 20, 2016

(54) EXPLOSIVE SEVER SEAL MECHANISM

(71) Applicant: SCHLUMBERGER TECHNOLOGY CORPORATION, Sugar Land, TX (US)

(72) Inventor: Timothy Andrzejak, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 182 days.

(21) Appl. No.: 14/193,442

(22) Filed: Feb. 28, 2014

(65) Prior Publication Data

US 2015/0247370 A1 Sep. 3, 2015

(51) Int. Cl.
*E21B 29/02* (2006.01)
*E21B 43/117* (2006.01)

(52) U.S. Cl.
CPC ..... *E21B 29/02* (2013.01); *E21B 43/117* (2013.01)

(58) Field of Classification Search
CPC ..... E21B 29/02; E21B 29/08
See application file for complete search history.

(56) References Cited

U.S. PATENT DOCUMENTS 3,329,219 A * 7/1967 Pausky ..... E21B 43/117 102/310
3,346,056 A * 10/1967 Bohn ..... E21B 43/117 175/4.6
4,323,117 A * 4/1982 Pierce ..... E21B 29/02 102/307
4,790,355 A * 12/1988 Kennedy ..... F16L 55/02 138/37
2003/0111220 A1* 6/2003 Bell ..... E21B 29/02 166/55
2010/0132578 A1 6/2010 Yang et al.
2012/0152561 A1* 6/2012 Herbel ..... E21B 29/08 166/360

* cited by examiner

*Primary Examiner* — William P Neuder
(74) *Attorney, Agent, or Firm* — Tuesday Kaasch

(57) ABSTRACT

A technique facilitates severing and sealing of a tubing, such as a tubing string located in a wellbore. The tubing is combined with a mechanism constructed to sever and seal the tubing. The mechanism comprises an internal explosive charge and an external explosive charge mounted inside and outside the tubing, respectively. The internal explosive charge is of sufficient size to sever the tubing upon detonation. Additionally, the external explosive charge is sized and oriented to collapse and seal at least one of the severed ends of the tubing once those severed ends are formed via detonation of the internal explosive charge.

17 Claims, 5 Drawing Sheets

EXPLOSIVE SEVER SEAL MECHANISM

BACKGROUND

In well applications, tubing strings are sometimes severed and sealed upon the occurrence of certain circumstances. For example, a tubing string deployed along wellbore may be severed and sealed to prevent contamination of the surrounding environment. In some environments, the rapid severing of the tubing string combined with sealing of the tubing string to prevent escape of hydrocarbon-based fluids or other fluids is difficult to achieve.

SUMMARY

In general, a system and methodology are provided for facilitating the severing and sealing of a tubing, such as a tubing string located in a wellbore. A tubing is combined with a sever and seal mechanism. The sever and seal mechanism comprises an internal explosive charge and an external explosive charge mounted inside and outside the tubing, respectively. The internal explosive charge is of sufficient size to sever the tubing upon detonation. Additionally, the external explosive charge is sized and oriented to collapse and seal at least one of the severed ends of the tubing which are formed upon detonation of the internal explosive charge.

Many modifications are possible, however, without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The disclosure herein generally involves a system and methodology which facilitate severing and sealing of a tubing. For example, the system and methodology may be employed to sever and seal a tubing string while the tubing string is located in a wellbore. The tubing is combined with a sever and seal mechanism having an internal explosive charge and an external explosive charge mounted inside and outside the tubing, respectively. The internal explosive charge is oriented and sufficiently sized to sever the tubing upon detonation. Additionally, the external explosive charge is oriented and sufficiently sized to collapse one or both of the severed ends of the tubing. The tubing is collapsed with sufficient force to seal either one or both of the severed ends of the tubing. In at least some embodiments, the tubing is collapsed and sealed immediately following formation of the severed ends via detonation of the internal explosive charge. In many applications, the detonations may be induced simultaneously or nearly simultaneously to both sever and seal the tubing in virtually the same instant.

In well applications, the construction of the sever and seal mechanism utilizes explosive charges arranged such that their dual initiation enables both the severing and sealing of tubing in many applications, e.g. downhole applications, subsea applications, and/or other well related applications. In an embodiment, an explosive charge internal to the tubing is in the form of a radial shaped charge to facilitate severing of the tubing, e.g. a downhole tubing string, over the 360° circumference of the tubing interior. During or after cutting of the tubing, an explosive charge external to the tube is detonated such that it squeezes the tubing shut in a manner which seals the tubing. Various arrangements of explosive charges may be employed to achieve the desired severance and sealing of the tubing.

Figure 1:
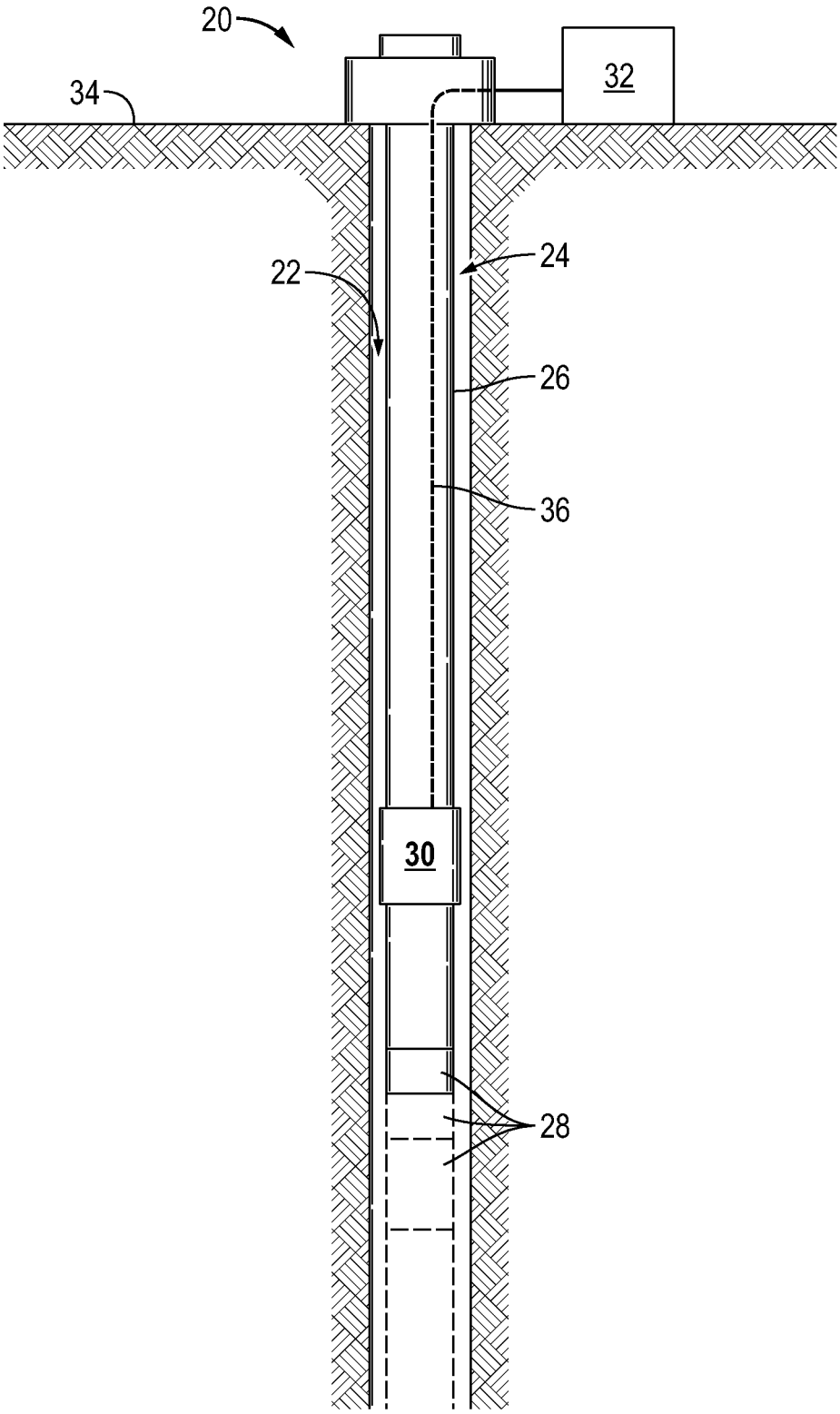
FIG. 1 is a schematic illustration of an example of a sever and seal mechanism positioned along a tubing string deployed in a wellbore, according to an embodiment of the disclosure.

Referring generally to FIG. 1, an example of a well system 20 deployed in a wellbore 22 is illustrated. In this example, well system 20 comprises a tubing string 24 having a tubing 26 and a variety of additional components 28. The number, type and arrangement of components 28 depend on the specific well application. Additionally, a sever and seal mechanism 30 is deployed along the tubing string 24 to enable selective severing of the tubing string 24 and sealing of the tubing string 24 to prevent fluid flow along the interior of the tubing string. By way of example, the sever and seal mechanism 30 may be mounted at a desired location along tubing 26 and may be positioned in or above the wellbore 22 depending on the parameters of a given application and the type of well system 20.

In the embodiment illustrated, the sever and seal mechanism 30 uses explosive material for both the severing and sealing operation. For example, an explosive charge may be positioned along the interior of the tubing string 24 to sever the tubing string. An external explosive charge may be positioned along the exterior of the tubing string 24 to collapse the tubing string 24 inwardly with sufficient force to seal off the tubing string against fluid flow through the severed end of the tubing string. Control over detonation of the explosive charges may be achieved via a suitable control system 32 positioned at, for example, a surface location 34.

The control system 32 may be coupled with the sever and seal mechanism 30 via a suitable communication line 36, such as a wired communication line. In some applications, control system 32 may comprise a series of pumps operated to pressurize the tubing string 26 in a manner which initiates a pressure-actuated firing system incorporated within the sever and seal mechanism 30.

Figure 2:
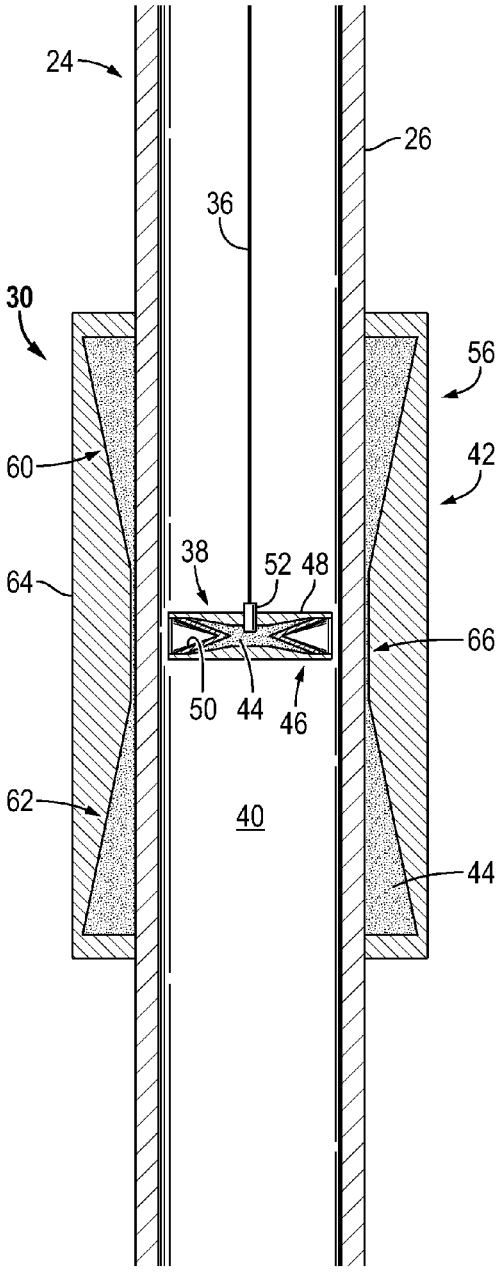
FIG. 2 is a cross-sectional view of an example of a sever and seal mechanism deployed along a tubing, according to an embodiment of the disclosure.

Referring generally to FIG. 2, an example of sever and seal mechanism 30 is illustrated as disposed at a desired location along tubing 26 of tubing string 24. In this example, the sever and seal mechanism 30 comprises an internal structure 38 disposed in an interior 40 of tubing string 24 and an external structure 42 disposed along an exterior of the tubing string 24. In some applications, the external structure 42 may be mounted to the tubing string 24 by suitable weldments, fasteners, and/or other attachment mechanisms.

In the illustrated embodiment, the internal structure 38 comprises an explosive charge formed of an explosive material 44 positioned and arranged to sever the tubing string 24 upon detonation. By way of example, the explosive material 44 may be contained in a shaped charge 46 oriented to sever the tubing string 24 upon detonation. Once detonated, the shaped charge 46 expels material and creates a detonation pressure which moves in a radial direction against and through the tubing string 24 from the radially inward position. The shaped charge 46 may be in the form of a radial cutter shaped charge which, upon detonation, expels material radially outward at high velocity along the entire circumference of the interior 40. In other words, detonation of explosive material 44 creates an outwardly directed severing force over 360° of the interior of tubing 26.

The explosive material 44 may be arranged in various configurations to achieve the severing of tubing string 24. If the explosive material is used in a shaped charge 46, such as the illustrated radial cutter shaped charge, the explosive material 44 may be held between a corresponding shaped charge housing 48 and a liner 50. In a variety of these embodiments, the explosive material 44 may be selectively detonated via a detonator 52 which may be activated via appropriate signals sent to the detonator 52 via communication line 36. In the embodiment illustrated, communication line 36 is in the form of a firing lead. When the explosive material 44 is arranged in shaped charge 46, detonation of the explosive material 44 causes the liner 50 to be expelled as a high-speed jet of material which propagates radially under high detonation pressure and severs the tubing 26.

Figure 3:
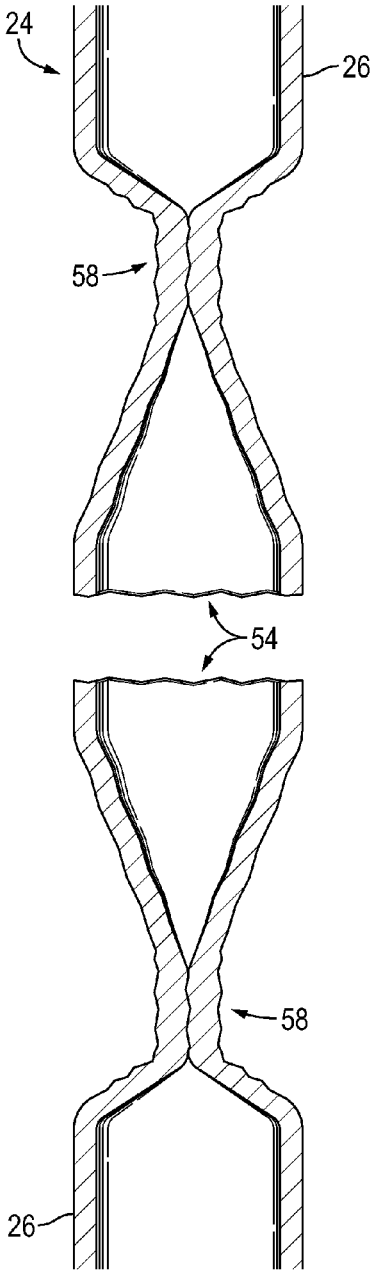
FIG. 3 is a cross-sectional view of the tubing following severance of the tubing and collapse and sealing of the severed tubing ends, according to an embodiment of the disclosure.

In the embodiment illustrated in FIG. 2, the external structure 42 comprises an explosive charge formed of explosive material 44 positioned and oriented to collapse and seal at least one severed end 54 of the tubing string 24 as further illustrated in FIG. 3. The explosive material 44 may be selected from various types of material used to create shaped charges for perforating well casing or for other well related activities that incorporate an explosive charge. Examples of explosive materials 44 that may be utilized include, but are not limited to, pentaerythritol tetranitrate (also known as PETN), cyclotrimethylene-trinitramine (also known as RDX), cyclotetramethylene-tetranitramine (also known as HMX), and hexanitrostilbene (also known as HNS). Additionally, the explosive material 44 used for external structure 42 may be the same or different than the explosive material 44 used for internal structure 38. By way of example, the explosive material 44 and external structure 42 may be arranged as a constricting charge 56 mounted along an exterior of the tubing string 24. The constricting charge 56 is sized and oriented to provide a controlled collapse of the tubing string with sufficient force to seal the severed end or severed ends 54 of the tubing string 24 following detonation of the constricting charge 56.

The constricting charge 56 may arrange the explosive material 44 with an increasing thickness moving in a longitudinal direction along the tubing string 24. The increasing thickness creates a build-up of detonation pressure along a longitudinal portion of the tubing string 24 as a detonation front propagates through the explosive material 44 following detonation. The build-up of detonation pressure collapses the tubing 26 in a controlled manner and ultimately applies sufficient force to seal shut the severed end or ends 54, thus establishing a constricted region or constricted regions 58 as illustrated in FIG. 3. In the specific example illustrated in FIGS. 2 and 3, the constricting charge 56 comprises a first charge section 60 and a second charge section 62 each constructed with increasing thickness of explosive material 44 on opposed, longitudinal sides of internal structure 38. In this example, detonation of the constricting charge 56 creates dual detonation fronts that propagate upwardly and downwardly along the severed tubing 26 to create a severed tube which is tapered shut at both severed ends 54.

By way of example, the increasing thickness of explosive material 44 may be achieved by arranging the explosive material 44 in a conical shape within a housing 64. In the embodiment of FIG. 2, each charge section 60, 62 is arranged in a conical shape of increasing thickness moving along tubing 26 away from internal structure 38. This arrangement of explosive material 44 creates the controlled collapse and sealing of both severed ends 54. However, the explosive material 44 may be arranged in a variety of other shapes, e.g. other shapes having increasing thickness, to achieve a desired, controlled collapse and sealing of the tubing string 24.

The detonation of constricting charge 56 may be initiated by a variety of techniques. For example, the embodiment illustrated in FIG. 2 utilizes a thin section 66 of explosive material 44 which extends into the expanding first and second charge sections 60, 62. The thin section 66 is positioned externally of tubing 26 at a radially outward position from internal structure 38. Thus, upon detonation of explosive material 44 in the internal structure 38, e.g. detonation of shaped charge 46, the thin section 66 also is detonated via the high velocity impact of material through the wall of tubing 26 as the tubing string 24 is severed. Detonation of the thin section 66 creates the detonation front which propagates through the explosive material 44 of constricting charge 56. Propagation of the detonation front through the conical or other expanding shape of the constricting charge 56 creates the controlled build-up of detonation pressure which collapses the severed end or ends 54 into sealed, constricted regions 58. However, the explosive material 44 of internal structure 38 and/or external structure 42 may be detonated by a variety of other mechanisms and techniques, as discussed in greater detail below.

Figure 4:
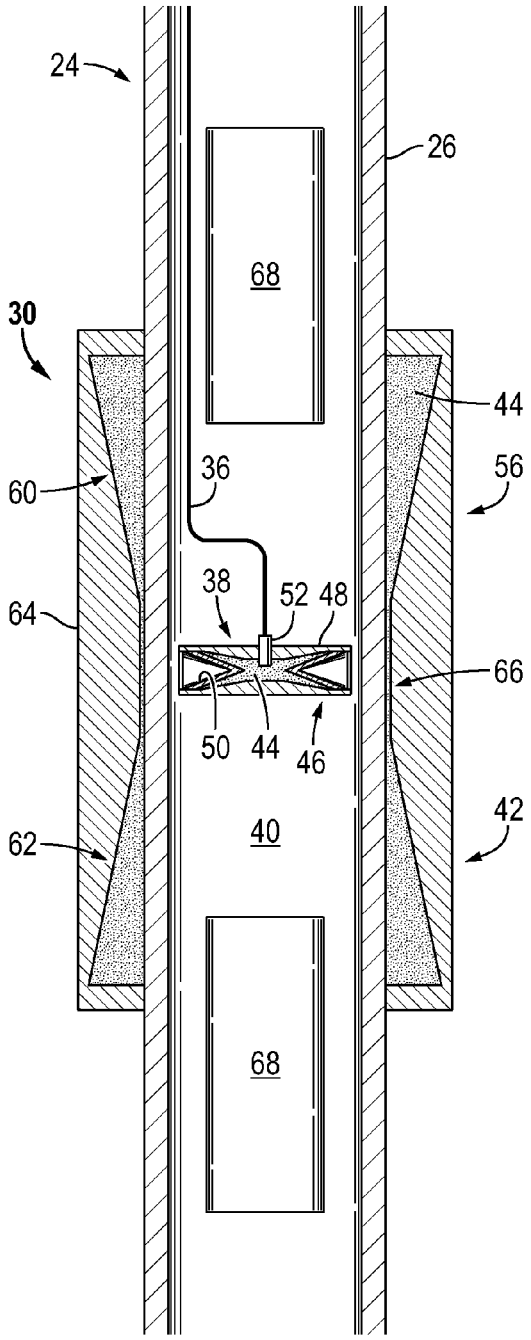
FIG. 4 is a cross-sectional view of another example of a sever and seal mechanism deployed along a tubing, according to an embodiment of the disclosure.

Referring generally to FIG. 4, another embodiment of sever and seal mechanism 30 is illustrated. In this embodiment, a plurality of bars 68 is positioned within tubing 26 in a manner which allows fluid flow along interior 40 prior to severing and sealing the tubing string 24. A variety of features, e.g. brackets, may be used to mount the bars 68 at the desired locations along interior 40 while still allowing fluid flow along interior 40. In this and other embodiments described herein, similar or the same features may be used to mount internal structure 38 within interior 40 while still allowing fluid flow along interior 40 prior to severing and sealing the tubing 26. In some applications, individual bars 68 and/or internal structure 38 may be suspended within tubing 26. In the example illustrated, bars 68 are positioned along interior 40 at locations radially inward of the constricting charge 56, e.g. radially inward of first charge section 60 and second charge section 62. Upon detonation of the constricting charge 56, the tubing 26 is squeezed down against the bars 68 to create the sealed, constricted regions 58 at severed ends 54. The bars 68 may be constructed in a variety of configurations and from a variety of materials. In an example, each bar 68 is formed of a metal material and has a generally circular circumference against which the tubing 26 is collapsed to seal off interior 44 against further fluid flow.

Figure 5:
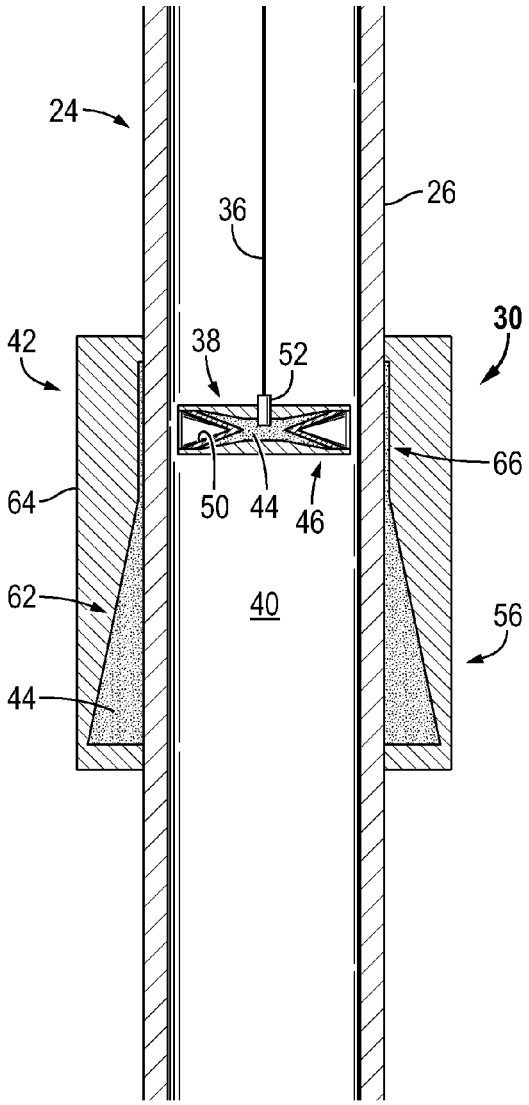
FIG. 5 is a cross-sectional view of another example of a sever and seal mechanism deployed along a tubing, according to an embodiment of the disclosure.
Figure 6:
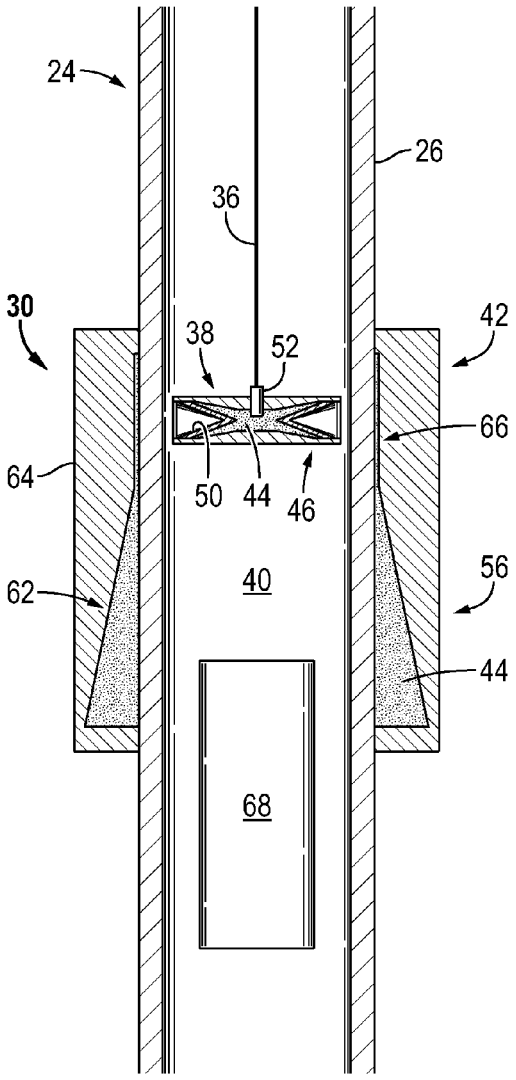
FIG. 6 is a cross-sectional view of another example of a sever and seal mechanism deployed along a tubing, according to an embodiment of the disclosure.

In some embodiments, the sever and seal mechanism 30 is constructed to enable the collapse and sealing of a single severed end 54, as illustrated in the examples of FIGS. 5 and 6. In FIG. 5, for example, an embodiment is illustrated in which the constricting charge 56 has a single charge section, e.g. charge section 62, with an expanding thickness of explosive material 44 to enable the controlled collapse and sealing of one of the severed ends 54. The single charge section can comprise either charge section 60 or charge section 62 depending on which severed end 54 is to be collapsed and sealed. A similar embodiment is illustrated in FIG. 6 in which a single bar 68, e.g. a metal bar, has been positioned within tubing 26 at a location radially inward of charge section 62 of constricting charge 56. In these embodiments, the constricting charge 56 is detonated via use of the exploding internal structure 38 which detonates the thin section 66 of explosive material 44.

Figure 7:
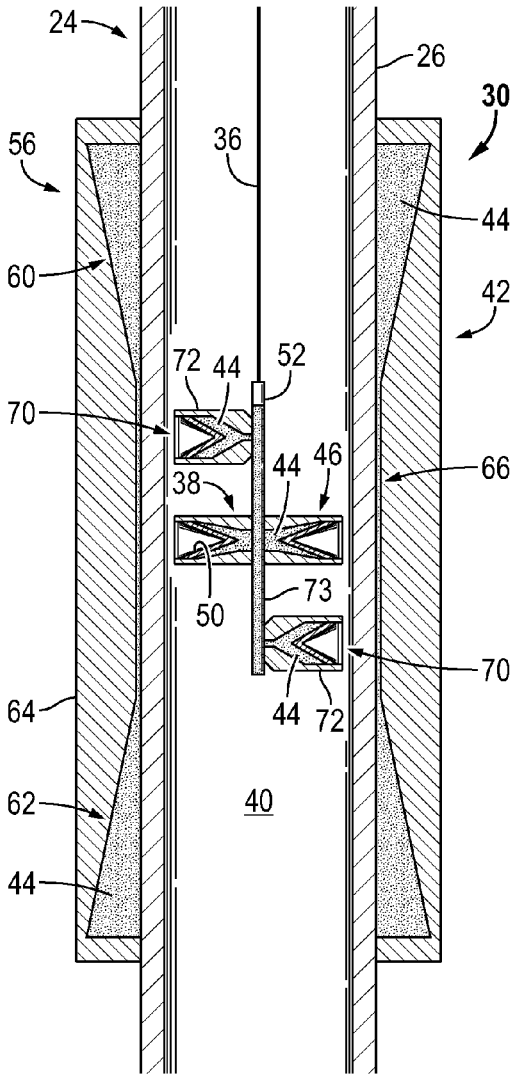
FIG. 7 is a cross-sectional view of another example of a sever and seal mechanism deployed along a tubing, according to an embodiment of the disclosure.

Depending on the application, the explosive material 44 of either or both the internal structure 38 and external structure 42 may be detonated by other techniques and devices. As illustrated in the example of FIG. 7, the detonation of constricting charge 56 may be initiated by a separate charge or charges 70. In the example illustrated, the constricting charge 56 comprises a pair of charge sections 60, 62 and a plurality of separate charges 70 is employed to initiate detonation of the constricting charge 56 at a corresponding plurality of locations. However, an individual separate charge 70 can be used to initiate the detonation. By way of example, the separate charges 70 may be in the form of shaped charges 72, such as conical shaped charges. In this example, detonator 52 comprises, or is ballistically connected to, detonating cord 73 which engages shaped charge 46 and the separate shaped charges 72. Upon initiation of the detonator 52, the detonating cord 73 is detonated and initiates the shaped charge 46 and the separate shaped charges 72.

Figure 8:
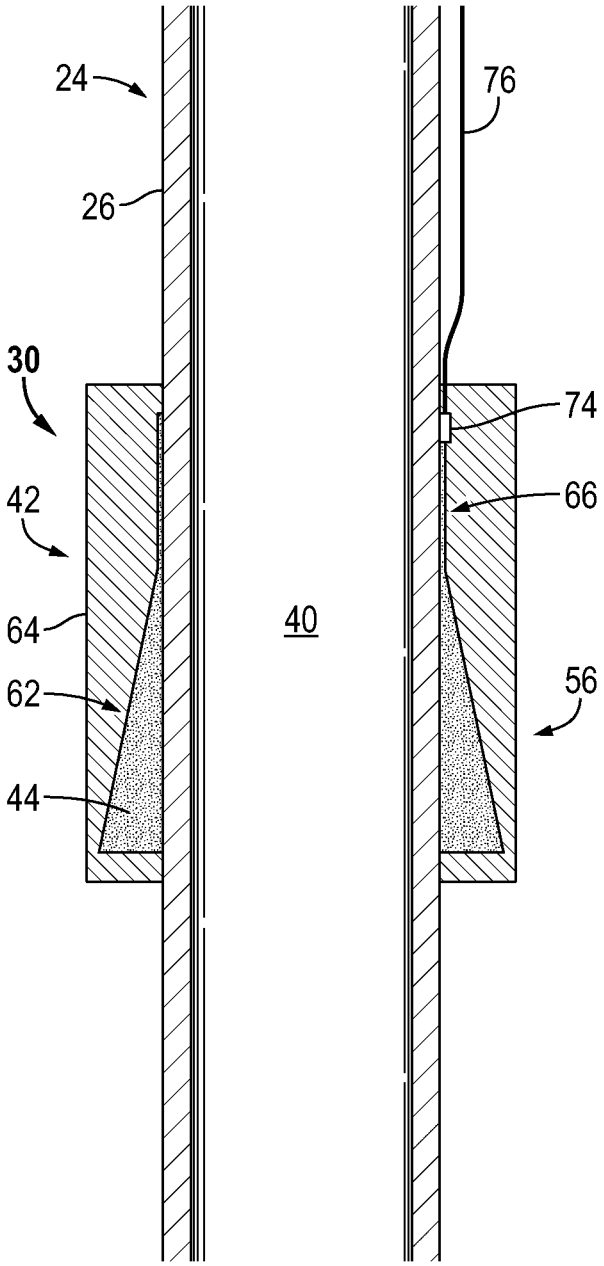
FIG. 8 is a cross-sectional view of another example of a sever and seal mechanism deployed along a tubing, according to an embodiment of the disclosure.

In some embodiments, e.g. the embodiment illustrated in FIG. 8, detonation of the constricting charge 56 may be controlled via a constricting charge detonator 74. Depending on the application, initiation of the constricting charge 56 may be desirable without severing the tubing 26. In other applications, initiation of the constricting charge 56 may be independent of initiation of the shaped charge 46. In the example illustrated in FIG. 8, the constricting charge detonator 74 is engaged with the thin section 66 of explosive material 44 to create the desired detonation front. The detonation front propagates along the tubing 26 through the explosive material 44 and builds up detonation pressure to provide a controlled collapse and sealing of the tubing 26. In some applications, this controlled collapse and sealing of tubing 26 is performed without severing the tubing 26. In the example illustrated, the constricting charge detonator 74 is coupled with a communication line 76, e.g. a firing lead.

Sever and seal mechanism 30 may be used in a wide variety of applications to selectively sever and seal individual tubing ends or a plurality of tubing ends. For example, the mechanism 30 may be used in well applications within wellbores, at subsea locations, at surface locations, and/or at other suitable locations along well related tubing. However, the sever and seal mechanism 30 also may be used in non-well applications to provide a rapid severing and sealing of tubing upon occurrence of a predetermined set of circumstances.

Additionally, the tubing system and/or sever and seal mechanism may comprise a variety of components, arrangements of components, and/or materials depending on the parameters of a given application. For example, the internal structure 38 may utilize a variety of explosive materials 44 arranged in shaped charges or other charges sized and oriented to sever the tubing at a desired location. Similarly, the external structure 42 may utilize a variety of explosive materials 44 arranged in desired shapes and orientations to provide the controlled collapse and sealing of the severed tubing ends. Examples of explosive materials 44 that may be utilized include, but are not limited to, pentaerythritol tetranitrate (also known as PETN), cyclotrimethylene-trinitramine (also known as RDX), cyclotetramethylene-tetranitramine (also known as HMX), and hexanitrostilbene (also known as HNS).

Various detonation techniques also may be employed to both initiate detonation and to control propagation of the detonation front. The housings, liners, bars, and other features employed in some embodiments of the sever and seal mechanism may be constructed in various configurations and from various materials to achieve the desired severing and sealing of a given tubing. In some applications, detonation at the internal structure and external structure may be simultaneous and in other applications the detonation may be separated and timed to achieve a specific order of severing, collapse, and sealing of the tubing.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for use in a well, comprising:
a tubing string deployed in a wellbore;
a shaped charge positioned in an interior of the tubing string, the shaped charge being oriented to sever the tubing string upon detonation; and
a constricting charge, mounted along an exterior of the tubing string, comprising an explosive material arranged with increasing thickness in a longitudinal direction along the tubing string to create a build-up of detonation pressure as a detonation front propagates through the explosive material.

2. The system as recited in claim 1, wherein the shaped charge is arranged as a radial cutter shaped charge oriented so a high velocity jet of material produced upon detonation of the shaped charge moves in a radial direction throughout the interior of the tubing string.

3. The system as recited in claim 1, further comprising a detonator coupled to the shaped charge.

4. The system as recited in claim 1, wherein the constricting charge is detonated via detonation of the shaped charge.

5. The system as recited in claim 1, wherein the constricting charge is detonated via a constricting charge detonator coupled to the constricting charge.

6. The system as recited in claim 1, wherein the constricting charge is detonated via a separate explosive charge.

7. The system as recited in claim 1, wherein the constricting charge comprises a first charge section and a second charge section, the first and second charge sections being positioned on opposite longitudinal sides of the shaped charge to collapse and seal severed ends of the tubing string on both sides of the shaped charge.

8. The system as recited in claim 7, wherein each of the first and second charge sections is conically shaped.

9. The system as recited in claim 1, further comprising a metal bar positioned in the tubing string at a location selected such that detonation of the constricting charge collapses the tubing string against the metal bar.

10. A method for use in a wellbore, comprising:

positioning a shaped charge in a tubing string at a tubing string severing location;

mounting a constricting charge externally of the tubing string;

providing the constricting charge with a conical shape which creates a build-up of pressure against the tubing string in a longitudinal direction along a portion of the tubing string upon detonation of the constricting charge; and deploying the tubing string into a wellbore.

11. The method as recited in claim 10, further comprising detonating the shaped charge to sever the tubing string, thus creating a pair of severed ends.

12. The method as recited in claim 11, further comprising detonating the constricting charge to collapse and seal at least one of the severed ends of the pair of severed ends.

13. The method as recited in claim 11, further comprising detonating the constricting charge to collapse and seal both of the severed ends of the pair of severed ends.

14. The method as recited in claim 10, wherein providing comprises providing the constricting charge with a pair of conically shaped charge sections positioned to collapse and seal each severed end the pair of severed ends.

15. The method as recited in claim 10, further comprising deploying a bar within the tubing string and within the constricting charge to facilitate sealing of the tubing string upon detonation of the constricting charge.

16. A system, comprising:

a tubing; and a sever and seal mechanism mounted along the tubing and comprising:

an internal explosive charge of sufficient size to sever the tubing upon detonation; and an external explosive charge mounted to the tubing along an exterior of the tubing, said external explosive comprising explosive material arranged to create a build-up of detonation pressure as a detonation front propagates through the explosive material and oriented to collapse and seal an end of the tubing formed upon severing of the tubing.

17. The system as recited in claim 16, wherein the internal explosive charge comprises a radial, shaped charge.

* * * * *